United States Patent [19]

Scott

[11] Patent Number: 4,982,820

[45] Date of Patent: Jan. 8, 1991

[54] CONTAINER FOR USE BY TRAVELLING SALES PERSON

[75] Inventor: Alan M. Scott, Dublin, Ireland

[73] Assignee: Eolas, Dublin, Ireland

[21] Appl. No.: 530,470

[22] Filed: May 30, 1990

Related U.S. Application Data

[63] Continuation of Ser. No. 282,125, Dec. 19, 1985, abandoned.

[51] Int. Cl.[5] ..... A45C 3/00; A45C 5/14

[52] U.S. Cl. ..... 190/16; 190/13 R; 190/15 R; 190/18 A

[58] Field of Search ..... 190/13 R, 14, 15 R, 190/15 A, 16, 17, 18 A

[56] References Cited

U.S. PATENT DOCUMENTS

| | | | |
|---|---|---|---|
| 139,420 | 5/1873 | Payne | 190/15 R |
| 792,793 | 6/1905 | Richmond | 190/16 |
| 1,595,622 | 8/1926 | Sanborn | 190/16 |
| 2,261,605 | 11/1941 | Smith | 189/16 X |
| 2,476,932 | 7/1949 | Tucker | 190/15 R |
| 2,639,793 | 5/1953 | Hellman | 190/16 X |

FOREIGN PATENT DOCUMENTS

| | | |
|---|---|---|
| 698062 | 10/1953 | United Kingdom . |
| 747385 | 4/1956 | United Kingdom . |
| 778628 | 7/1957 | United Kingdom . |
| 929458 | 6/1963 | United Kingdom . |
| 1598522 | 9/1981 | United Kingdom . |

*Primary Examiner*—William I. Price

*Attorney, Agent, or Firm*—Poms, Smith, Lande & Rose

[57] ABSTRACT

A container for use by a travelling sales person to transport goods, especially garments, from one retail outlet to another comprises a bag with a display stand secured therein and movable between a collapsed state within the bag for transportation purposes and an erect state projecting from the bag for display purposes.

6 Claims, 4 Drawing Sheets

CONTAINER FOR USE BY TRAVELLING SALES PERSON

This is a continuation of Ser. No. 07/282,125 filed Dec. 9, 1988 now abandoned.

BACKGROUND OF THE INVENTION

The present invention relates to bags, suitcases or other similar containers for use by travelling sales persons in transporting goods from one retail outlet to another.

One particular difficulty which travelling sales persons experience when visiting retail outlets for the purpose of selling their goods, especially large items such as garments, textiles, carpets or shoes, is that at each retail outlet they must unpack the contents of the bag or suitcase, lay out the goods on a counter or other surface for display purposes, and subsequently repack the goods. Unpacking and repacking is time consuming and laborious. Furthermore, it is often inconvenient to occupy a counter or other surface, as the retailer may want to make use of the limited counter space to sell his goods to customers.

SUMMARY OF THE INVENTION

An object of the present invention is to overcome the above difficulties and to provide the sales person with a means for displaying sales goods more quickly and conveniently and to better effect.

The present invention provides a container of the type described provided with a display stand secured therein and movable between a collapsed state within the bag for transportation purposes and an erect state projecting from the bag for display purposes.

The container according to the invention eliminates the need for time consuming packing and unpacking of goods and thus enables the sales person to make more visits on each working day. Furthermore, the container allows goods to be displayed without using counter space in the retail outlet.

Advantageously, the collapsible/erectable display stand is a garment display stand comprising a base, a vertical column, and a horizontal rail mounted at the top of the column, and the vertical column is telescopic between an erect extended state and a collapsed contracted state.

The use of a garment display stand of the above type allows the sales person to display garments to the retailer in a manner similar to the manner in which the retailer would in turn display the garments to customers. Furthermore, the garment display stand of the above type occupies very little of the internal volume of the bag.

Advantageously, the horizontal rail is telescopic from a contracted state in which, with the vertical column also contracted, the display stand fits entirely into the bag, to an extended state in which, with the vertical column also extended, the horizontal display rail projects beyond the dimensions of the bag increasing the effective size of the display stand.

As a result of the telescopic nature of the horizontal rail, for transportation purposes the garments may be densely packed one against the other all along the length of the contracted horizontal rail so as to fill the bag with garments, and for display purposes the garments may be spaced apart along the extended rail to allow individual garments to be viewed.

Advantageously, the telescopic vertical column includes a securing mechanism which on the one hand is biased to prevent the telescopic vertical column contracting but is releasable to allow such contraction, and on the other hand allows the telescopic vertical column to be freely extended.

A securing means of the kind mentioned allows the sales person to quickly erect the display stand by simply pulling the horizontal rail upwards, thereby enabling the sales person to rapidly attract and retain the attention of retailers.

Advantageously, the bag consists of flexible walls and a three dimensional open frame for supporting the walls when the container is to be used in the transportation or display mode, the open frame being capable of being collapsed or disassembled into two dimensions, and the display stand may also be capable of collapsing further beyond the storage mode or of being disassembled into two dimensions.

The container can then be conveniently stored when not in use by collapsing or disassembling the open frame and the display stand into two dimensions and storing these in the bag, the walls of which also collapse when not supported by the open frame.

BRIEF DESCRIPTION OF THE DRAWINGS

The invention will now be described more particularly with reference to the accompanying drawings which show, by way of example only, one embodiment of container according to the invention, comprising a bag and display stand. In the drawings.

DETAILED DESCRIPTION

Figure 1:
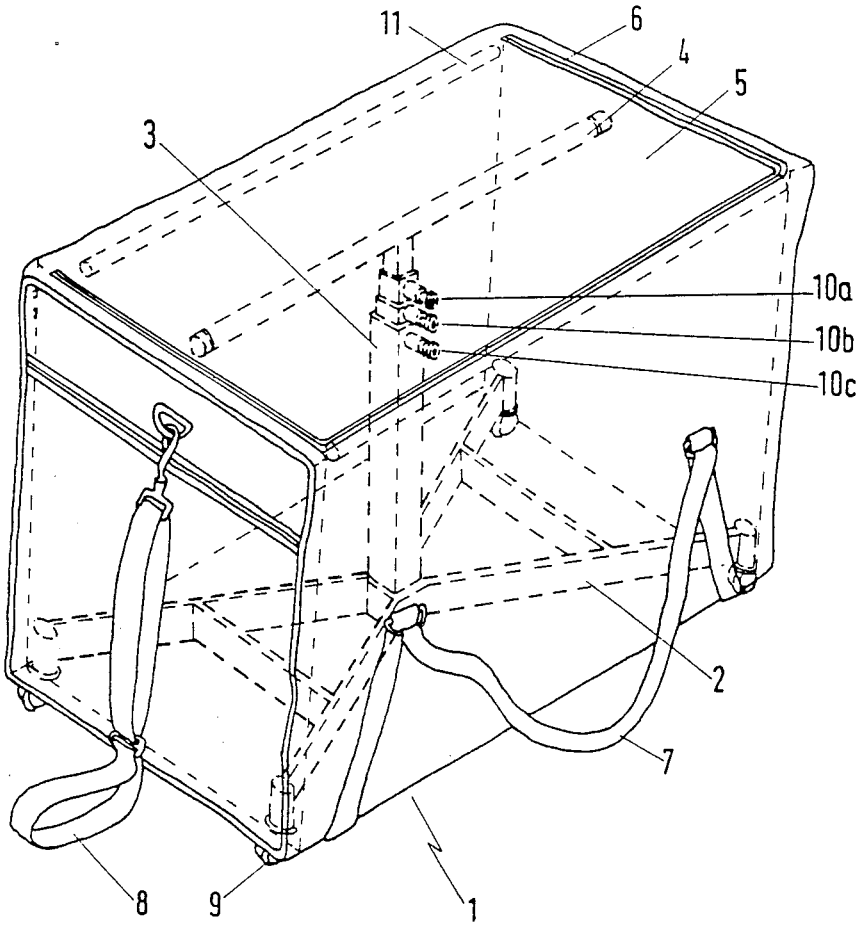
FIG. 1 is a perspective view of the bag in the transportation mode, that is to say closed and with the garment display stand (shown in dashed lines) in the collapsed state entirely within the bag.

Referring now to the drawings, the container comprises a bag 1 and a garment display stand comprising a base 2, a vertical support column 3 which is telescopic, and a horizontal display rail 4 which is also telescopic.

FIG. 1 shows the container in the transportation mode. The vertical support column 3 is in the contracted state. The horizontal display rail 4 is also in the contracted state. The garments have been omitted from the drawings for clarity, but in the transportation mode the garments are mounted on garment hangers (also omitted) suspended from the horizontal display rail 4, and the garments are densely packed one against the other. The flap 5 of the bag 1 is folded over and is closed by means of a zip fastener 6. The bag 1 may be carried by the sales person by means of handles 7. Alternatively, the bag 1 may be pulled from place to place by the sales person by means of strap 8, with the bag rolling on castors 9. The bag 1 is of a suitable size to fit into the trunk of a car.

Figure 2:
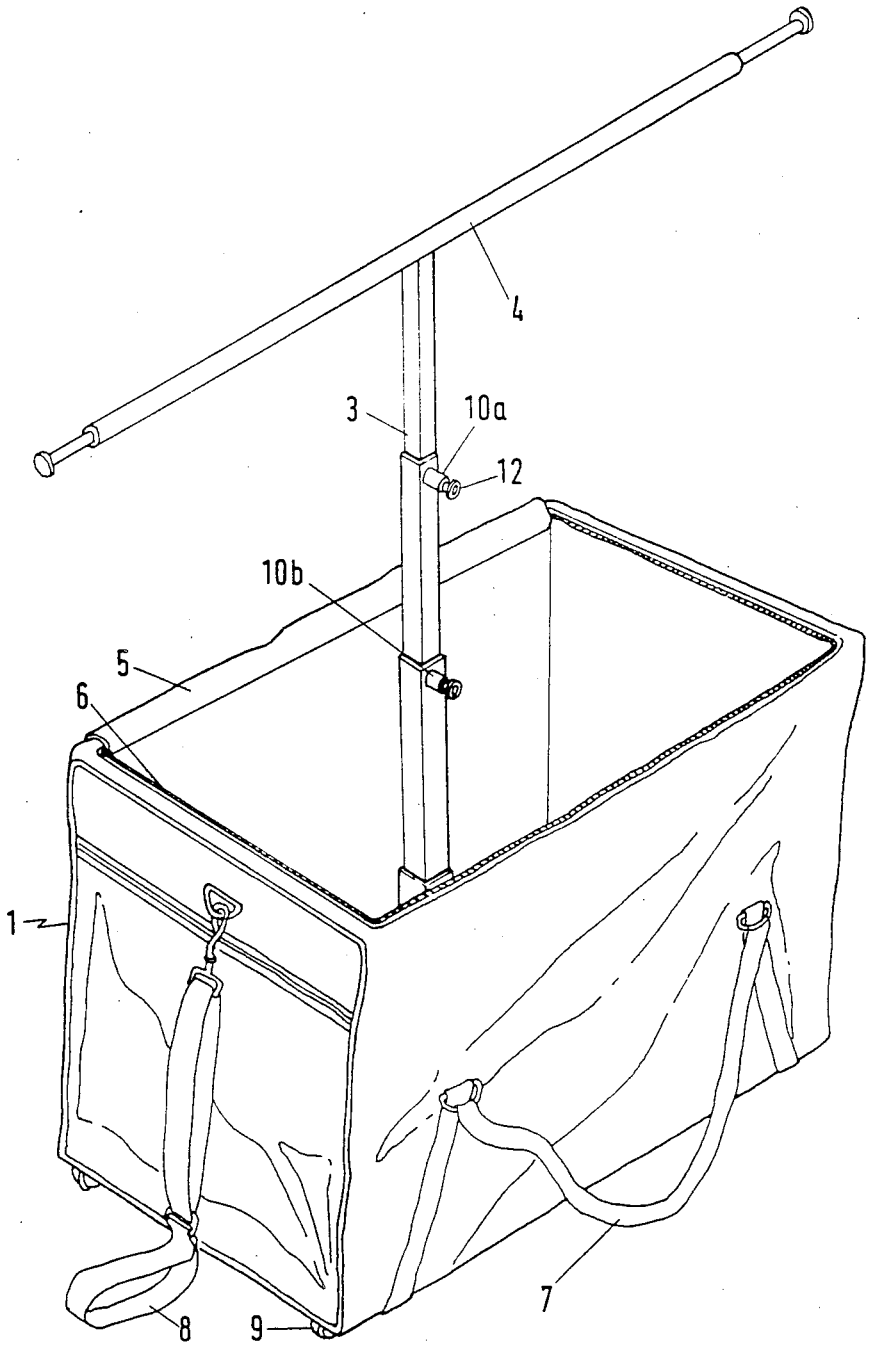
FIG. 2 is a similar view of the bag in the display mode, that is to say open and with the garment display stand in the erect state projecting up from the bag.

FIG. 2 shows the container in the display mode. At a retail outlet the sales person simply unzips the flap 5 and moves it to the open position, and then pulls the horizontal display rail 4 upwardly thus extending the vertical support column 3. The garments are now on view to the retailer In order to allow the retailer to view an individual garment, the sales person may extend the horizontal display rail 4 telescopically from the contracted state shown in FIG. 2 to an extended state thereby allowing more space on the rail. In particular, when the retailer wishes to view a particular garment, the garments on each side of that garment may be pushed away along the rail 4 so as to allow better viewing. When viewing has been completed the sales person first pushes all the garments back together onto the central section of the telescopic horizontal display rail 4, then telescopes the horizontal rail 4 to its contracted state, and then operates the securing mechanisms 10*a*, 10*b* and 10*c* in sequence to allow the vertical column 3 to telescope to its contracted state within the bag 1, and finally folds over the flap 5 and secures it in the closed position by means of the zip fastener 6.

Figure 3:
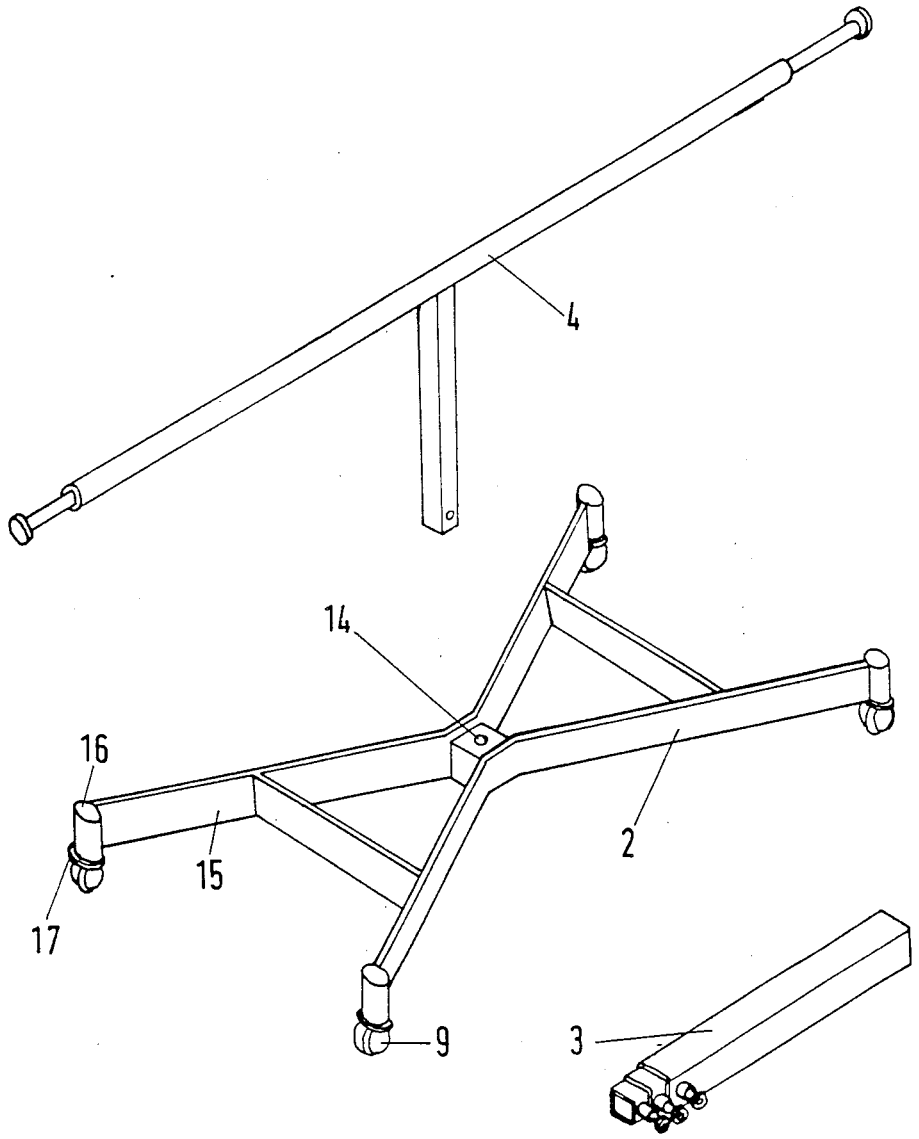
FIG. 3 is an exploded perspective view of the garment display stand, showing how it may be disassembled for storage when it is not being used for transportation or display.
Figure 4:
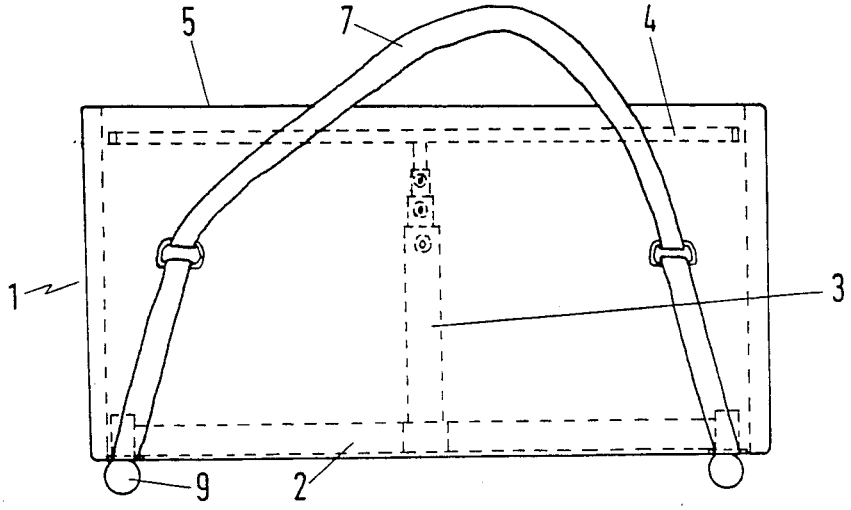
FIG. 4 is a side elevation of the bag in the transportation mode.

FIG. 3 shows the display stand disassembled when it is not required for transportation or display purposes. It will be seen that the display stand can be disassembled into three smaller sub-assemblies, namely the base 2, the vertical support column 3 and the horizontal display rail 4 and uppermost telescopic section of the column 3, each of which sub-assemblies is generally planar. The subassemblies can be placed in the bag 1. The bag 1 can also be collapsed to a flat state. Collapsing of the bag 1 is effected by removing and collapsing the internal frame 11. FIG. 1 shows some but not all of the elements of the frame 11. The disassembled display stand and the collapsed internal frame 11 can then be put in the bag 1.

Figure 5:
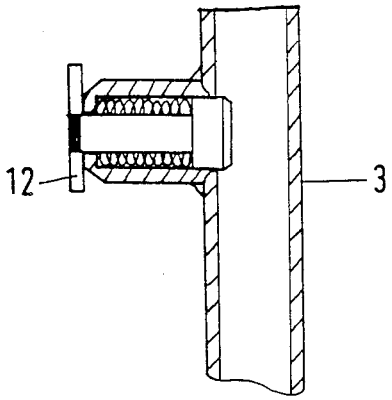
FIG. 5 is a sectional elevation on a much larger scale of a detail of the telescopic mechanism.

The securing mechanisms 10*a*, 10*b*, 10*c* will now be described with reference to FIG. 5. Each securing mechanism comprises a spring loaded plunger 12 near the top of one telescopic section and a complementary socket 13 near the bottom of the next section. When a particular telescopic section is pulled upwards the socket 13 at the bottom thereof comes into register with the plunger 12 at the top of the following telescopic section, and the plunger 12 engages in the socket 13 preventing further relative movement. The telescopic section may be lowered again by withdrawing the plunger 12 against the spring bias. In this way the vertical column 3 may be extended or contracted in a stepwise manner.

Certain constructional details of the bag 1 and display stand will now be described. The base 2 of the display stand has a seat 14 for receiving and locating the lower end of the vertical column 3. The seat 14 is recessed thereby preventing the vertical column 3 rotating and thus unscrewing from the base 2. The base 2 comprises four feet 15 each of which is provided with a downwardly facing socket 16 for receiving the screw threaded shank of a castor 9. The shank of each castor 9 extends upwardly through a castor protection plate 17 (see FIG. 3) immediately above the castor, through an eye in the single continuous strip of material which forms the two handles 8, through an eye in the material of the bag 1 and into the socket 16. The bag 1 is provided on the inside end faces with pockets (not shown) for receiving sales literature.

In an alternative construction the base of the display stand may comprise a rectangular board (not shown).

The construction according to the invention may also be used by a traveller to transport the traveller's personal clothing. For example a business traveller may use the container to transport business suits and shirts.

I claim:

1. A container, for example a bag or suitcase, for use by a travelling sales person in transporting goods from one retail outlet to another provided with a display stand movable between a collapsed state within the bag for transportation purposes and an erect state projecting from the bag for display purposes, in which the display stand is a garment display stand comprising a base, a multisectional vertical column, locking means biassed into a locking position for securing each of the sections of the vertical column to a next section when the vertical column is brought from a collapsed contracted state to an erect extended state, and a horizontal rail mounted centrally at the top of the column, and the vertical column is telescopic between an erect extended state and a collapsed contracted state whereby the display stand may be brought into the erect extended state by an operator by a single-handed continuous movement.

2. A container according to claim 1, in which the horizontal rail is telescopic from a contracted state in which, with the vertical column also contracted, the display stand fits entirely into the bag, to an extended state in which, with the vertical column also extended, the horizontal display rail projects beyond the dimensions of the bag increasing the effective size of the display stand.

3. A container according to claim 1, in which the locking means is releasable to allow contraction of the multisectional vertical column.

4. A container according to claim 1, in which the bag consists of flexible walls and a three dimensional open frame for supporting the walls when the container is to be used in the transportation or display mode, the open frame being capable of being collapsed or disassembled into two dimensions, and the display stand may also be capable of collapsing further beyond the storage mode or of being disassembled into two dimensions.

5. A container according to claim 2, in which the locking means comprises a plurality of spring loaded plungers one of which is fixed on the lowermost of any pair of interengaging sections of the vertical column and the walls of the sections of the vertical column are provided with a plurality of apertures, each aperture being adapted to receive and engage with the plunger of the locking means to retain the telescopic vertical column at one of a number of preselected heights on extension of the said vertical column.

6. A container according to claim 1, in which wheeled elements are provided on the bag to enable the bag to be wheeled by a user.

* * * * *